United States Patent [19]

Pawletko

[11] 4,335,967

[45] Jun. 22, 1982

[54] ELECTROLYTIC PRINTING APPARATUS INCLUDING PREHEATING PRESSURE PAD THEREFOR

[75] Inventor: Joseph P. Pawletko, Endwell, N.Y.

[73] Assignee: International Business Machines Corporation, Armonk, N.Y.

[21] Appl. No.: 240,332

[22] Filed: Mar. 3, 1981

[51] Int. Cl.[3] ..... B41J 3/02

[52] U.S. Cl. ..... 400/119; 101/1; 101/DIG. 13; 346/165; 219/216

[58] Field of Search ..... 400/119; 101/DIG. 13; 346/165; 219/216; 118/101; 427/369, 370

[56] References Cited

U.S. PATENT DOCUMENTS

| | | | |
|---|---|---|---|
| 3,546,707 | 12/1970 | Dixon et al. | 346/165 |
| 3,739,087 | 6/1973 | Metcalfe | 346/165 |
| 3,955,530 | 5/1976 | Knechtel | 118/101 X |
| 4,159,479 | 6/1979 | Alden | 346/165 |
| 4,182,263 | 1/1980 | Naeser et al. | 118/101 X |
| 4,251,827 | 2/1981 | Fujii | 346/165 |

OTHER PUBLICATIONS

Wilber "Electrothermal Print Head" IBM Tech. Disc. Bulletin, vol. 23, No. 9, Feb. 1981, pp. 4305-4306.

*Primary Examiner*—E. H. Eickholt

*Attorney, Agent, or Firm*—Saul A. Seinberg

[57] ABSTRACT

A preheating pad and assembly for electrolytic printing apparatus is provided. The pad is adjustably mounted to the write head of the printer for movement normal to the recording medium used therein. The pad is fabricated from a ceramic chip and includes a resistive heating element that is protected by a thin bottom layer provided for that purpose.

It is joined to an insulated carrier arm by a spring which serves to electrically and mechanically couple the pad and the print head. The biasing effect made possible by the spring allows the pad contact pressure with the recording medium surface to be tuned or adjusted as required. In operation, the pad's position is adjusted to force moisture deposited by an applicator on the surface of the recording medium to penetrate the recording medium's surface layer while simultaneously heating both the surface layer's constituent materials and the fluid being driven therein.

8 Claims, 4 Drawing Figures

ELECTROLYTIC PRINTING APPARATUS INCLUDING PREHEATING PRESSURE PAD THEREFOR

BACKGROUND OF THE INVENTION

1. Field of the Invention

This invention is directed to apparatus for electrolytic printing. It is particularly concerned with the provision of a heated pressure pad in such apparatus which will significantly enhance printing quality and speed while reducing energy requirements.

2. Description of the Prior Art

The concept of electrically generated printing has sparked interest since the 1840's. Most attempts at utilizing an electrically initiated reaction by which printing could be accomplished required relatively high voltages, in the order of 100 to 250 volts as that term is used herein, saturated or completely wetted paper and/or consumable electrodes. It was also necessary to employ a recording medium which would be suitable for the particular printing system being used. Almost all of these prior art systems relied on either relatively high voltage pulses to achieve "dry" printing or on saturation of the recording medium to accomplish "wet" printing. As might be expected, there were also hybrid systems and recording mediums therefor that attempted to reconcile and/or compensate for the disadvantages of both the dry and wet approaches. However, as is the case with most compromise situations, these efforts were either too expensive to implement or unsatisfactory in output performance.

Various efforts were made to improve different aspects of the prior art printing systems. Among these were attempts directed to improving operating efficiency and/or print quality by pre-heating the print electrode, the recording medium or both. One such effort, which is related in subject matter to the present invention, was directed to heating a print stylus in order to improve the record formed thereby and is described in U.S. Pat. No. 2,454,966 to Faus. In this arrangement, a stylus formed from a resistance heating element, such as nichrome, is connected to a source of energy which heats the stylus when current flows therethrough. The heated stylus, in turn, rests on the lacquer coated surface of the recording medium employed and thus warms that surface prior to printing. The heated stylus renders the lacquer more transparent and softer, as well as more easily scraped off, to thereby expose a darker layer below the medium's surface.

U.S. Pat. No. 4,039,065 to Seki et al also discloses another effort to improve prior art printing apparatus by incorporating a preheating roller therein. The roller serves to heat the recording medium prior to printing and thereby lowers the total heat or energy that is needed by the print electrodes for application to the recording medium. The recording medium is thereby rendered more amenable to printing at a lower print electrode power level. However, while there was a reduction in the energy required at the print electrodes, there was no appreciable reduction in the total energy required to effect printing. This approach did lengthen print head life in the Seki et al apparatus.

The results of preheating were advantageous in printing systems based on electrolytic action and particularly useful in such a system where low voltage levels were employed to cause printing. One printing system that functions at low energy printing levels, of the magnitude associated with today's densely populated integrated circuit chips, is described in the commonly assigned U.S. patent application Ser. No. 237,560 filed on Feb. 24, 1981 by Bernier et al. In this arrangement, a leuco dye resident in the surface layer of the recording medium used therein is rendered visible by the application of a low energy pulse thereto providing the surface layer thickness, the contact surface area of the electrodes and the spacing between the electrodes are all set to predetermined values.

While operation of this printing arrangement would benefit from using one type or another of preheating device, those proposed in the prior art are not entirely suitable or satisfactory. The use of a preheated stylus or print electrodes, for example, would not be satisfactory in such a system for several reasons. The additional energy required at the stylus would not be compatible with the system's energy and voltage level constraints. In addition, a heated print stylus, by itself, would also detract from printing performance as it would further dry out the recording medium and retard the electrolytic reactions required to effect printing. The employment of a heated roller would also remove moisture from the recording medium and adversely affect print quality. Its effectiveness in increasing print head life would be more than offset by its additional energy use and dryness promotion. Furthermore, in neither prior art situation is the heating range of the stylus or roller limited or compensated for. Clearly, if the level of preheating cannot be assured or controlled, adverse printing results will occur before preventative or compensatory measures can be taken.

It has been found, as with most paper, that the recording medium tends to dry out between the time it is fabricated and the time it is actually used to print on. This situation, however, can be overcome in this particular printing environment by wetting the recording medium surface slightly, immediately prior to printing. Obviously, any effort to enhance print quality solely by heating the print stylus, using a preheated roller or some combination thereof in this particular low energy printing apparatus without compensating for the dryness problem would not be effective. The same would be true, in fact, for any electrolytic printing process whether it was low or high energy input driven.

OBJECTS AND SUMMARY OF THE INVENTION

It is, therefore, a principle object of the subject invention to apparatus that works in conjunction with a moisture applicator.

It is also an object of the present invention to provide a preheating element that will enhance the effects of a moisture applicator used in an electrolytic based printer rather than work at cross-purposes therewith.

It is a further object of the present invention to provide a preheating element that will allow cost-saving size and power reductions in the print head of such a printer.

It is yet another object of the present invention to provide a preheater for an electrolytic based printer that can be automatically controlled or compensated for in use.

It is an additional object of the present invention to provide a preheating element for an electrolytic based printer that will accelerate both moisture penetration into the surface of the recording medium and the rates of chemical reaction therein.

These and other objects of the present invention are accomplished by providing a pad which is adjustably mounted on the write head of an electrolytic based printer for movement at least normal to the recording medium used in said printer. The pad itself is affixed to insulated carrier means which serves to mechanically join the pad and the write head. The pad's adjustable mounting permits it to be placed at a predetermined distance above or in contact with the recording medium surface. Biasing means, provided for that purpose, allow the pad contact pressure with the recording medium surface to be tuned or adjusted as required. The biasing means are also selected so that electrical connection to the pad can be made thereby. In operation, the pad is adjusted to force the moisture deposited on the recording medium surface by applicator means into that surface while simultaneously heating both that surface and the fluid being driven therein without itself causing printing. The pad itself comprises a ceramic chip of appropriate size having a plurality of resistance elements formed as an exposed pattern thereon. The pad is heated by passing current through the metallized resistance elements thereof.

BRIEF DESCRIPTION OF THE DRAWINGS

Referring now to the drawings wherein like reference numerals have been used in the several views to depict like elements.

DESCRIPTION OF THE PREFERRED EMBODIMENT

As used herein, the phrases "low voltage" or "low electrical energy" or their equivalent means that a voltage pulse of no more than 25 volts amplitude is applied for an appropriate time to the print electrode. Preferably, the "write" pulse can be held to no more than 15 volts. The reasons therefor and the details of how printing is effected in a low voltage, electrolytic printer can be had by referring to the aforementioned Bernier et al patent application, which is incorporated herein by reference to the extent necessary.

Figure 1:
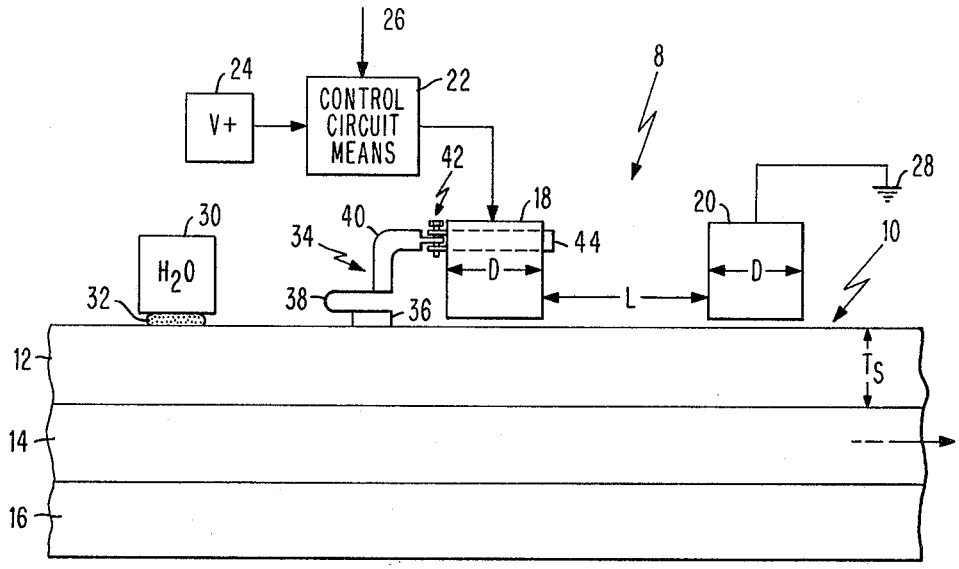
FIG. 1 schematically illustrates low energy, electrolytic printing apparatus which incorporates a preheating assembly in accordance with the present invention.

FIG. 1 schematically illustrates exemplary low energy, electrolytic based printing apparatus 8 which has been adapted to include the present invention. It will be understood by those having skill in this art that the present invention is equally and satisfactorily employable in high or intermediate energy input printing apparatus. Thus, it will be appreciated that the low energy apparatus chosen as the expository context for the present invention has been selected solely for the sake of descriptive convenience. As shown, the apparatus 8 utilizes a recording medium 10 which is comprised of a surface layer 12, an intermediate conductive layer 14 and an insulating base or support layer 16. The surface layer 12 is typically about 5 to 50 microns thick and includes five main components, the most important of which is a leuco or 1-dye, a dye whose chromophore is not visible under ordinary room conditions. It can, however, be permanently shifted into the visible spectrum when a pulse of sufficient energy is applied thereto. The conductive layer 14 is generally formed from a thin metal foil, such as aluminum, about 1000 angstroms thick or from an electrolytic coating, such as NaCl, of a suitable salt. The support layer 16 serves only, as its name implies, to support the surface and conductive layers 14 and 16. The support layer 16 is typically about 15 to 50 microns thick and fabricated from ordinary paper.

The printing apparatus 8 also includes a write electrode or print stylus 18 to and under which the recording medium 10 is transported by any suitable and conventional transport mechanism, which is not shown, for printing. The write electrode 18 is usually formed of tungsten or similar suitable material. Due to the fact that the write electrode may be partially consumed in use, a ruthenium oxide coated electrode, which compound is very stable and exhibits little or no tendency to chemically enter into the electrolytic printing process, may alternatively be employed. The cathode or ground electrode 20 would be fabricated from a similar, if not identical, material and is separated from the write electrode 18 by a predetermined distance L. Both the write electrode 18 and the ground 20 electrode are assumed to have the same diameter D, since all will likely be fabricated from the same stock and thereafter coated if appropriate. As described and illustrated herein, the write and ground electrodes are assigned the status of individual elements for the sake of clarity and ease of explanation. In actual apparatus of this type, a plurality of write and ground electrodes are all incorporated in one print head. It is intended that the electrodes described herein should be assumed to be similarly implemented and that no limitations should be implied from the simplified nature of their description. As noted in the aforementioned patent application by Bernier et al, to which reference should be made for further and more specific details, the diameter D of electrodes 18 and 20 and the distance L which separates them, together with the thickness $T_s$ of the surface layer 12, are predetermined to insure that their combined effect will enable low energy input levels to achieve satisfactory printing.

A control circuit 22 is coupled between an appropriate source 24 of energy and the write electrode 18. Control circuit 22 is of conventional design. The control circuit 22 serves to form and then selectively forward voltage pulses of appropriate amplitude and width to the write electrode 18. The generation and provision of such pulses would, in turn, be subject to the receipt of enabling signals therefor which are made available to the control circuit 22 on its input line 26. Once enabled, control circuit 22 provides pulses which cause current flow through the write electrode 18 into the recording medium 10, primarily in and through the conductive layer 16. A return path therefor to ground 28 is made available back through the ground electrode 20.

In order to facilitate and enhance printing, a liquid applicator 30 is provided. The applicator 30 is adapted to uniformly disperse or meter out very small quantities of liquid, preferably water, over the surface layer 12 of recording medium 10, just prior to its passing under the write electrode 18. The application of the liquid to the surface layer 12 of the recording medium serves, at least, a three-fold purpose. Since the write electrode 18 is positioned to be about flush with the top of surface layer 12, the presence of liquid thereon reduces frictional forces and thereby promotes increased printing speed. In addition, the presence of liquid on the surface layer 12 greatly assists in promoting the electrolytic printing reaction by increasing the conductivity thereof. Further, the availability of the liquid on the surface layer 12 reduces the dryness of the entire layer as it is absorbed therein, which also promotes printing as increase conductivity becomes more than just a surface event. About 0.4 ml of liquid has been found to be satisfactory for each standard 8½ by 11 inch piece of medium to be printed. The particular liquid selected for use will depend upon the nature of the surface layer 12 components, particularly what fluids they would be soluble in. From economic and safety standpoints, water is the preferred fluid, but other liquids that are compatible with the surface layer components could be employed.

The liquid applicator 30 includes a pair of rollers which are held apart during any non-printing or idle portion of operation by a cantilevered mounting assembly (not shown). This mounting arrangement avoids the unnecessary application of liquid to the recording medium. The roller 32 which contacts the surface layer 12 is wetted by an internal wick of predetermined porosity. Specific and further details of the applicator 30, which form no part of the present invention.

Figure 2:
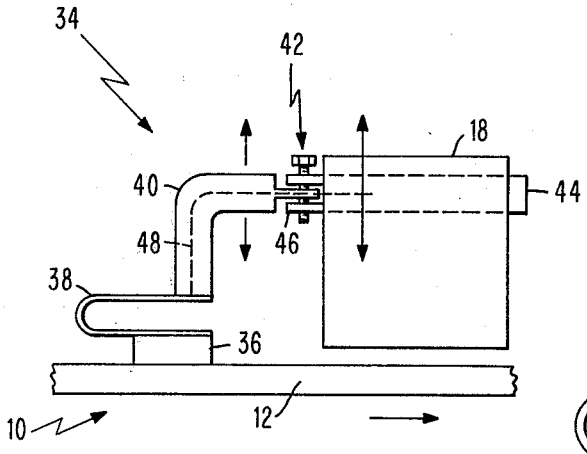
FIG. 2 illustrates an expanded, more detailed view of the preheating assembly shown in FIG. 1 and its association with the write electrode of the printing apparatus depicted therein.

The preheating pad assembly 34 is shown in both FIGS. 1 and 2. It is mounted by means of a slidable collar assembly 42 to the write electrode 18 which will permit movement thereof normal to the recording medium 10. The collar assembly 42 makes it possible for the pad force on the surface layer 12 to be adjusted as needed. It has been found that a force of approximately 40 gr/cm has the most optimal result. The pad assembly 34, to the extent that the write electrode 18 is movable in a particular printing arrangement across the recording medium 10, will move with it or else remain fixed. This assembly includes a pad 36, a spring or biasing means 38 and a carrier arm 40 made of insulating material. Attaching the carrier arm directly to the write electrode 18 insures that the recording medium 10 area immediately adjacent the print zone is being prepared for enhanced or more efficient printing. The horizontal standoff of the arm 40 from the write electrode 18 is selected to prepare an optimal area of the recording medium 10. Alternatively, the arm 10 could be connected by conventional movable means to the write electrode 18 so that the extent of its horizontal projection from the write electrode 18 can be adjusted as needed.

Figure 3:
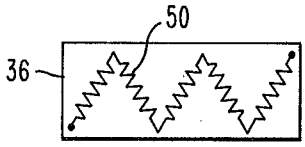
FIG. 3 shows a bottom view of the pad used in the preheating assembly of FIGS. 1 and 2, including the resistive element pattern thereof.
Figure 4:
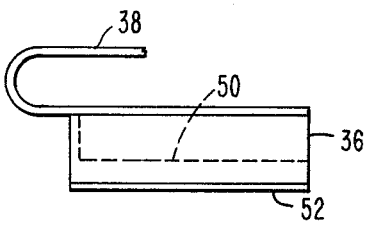
FIG. 4 illustrates a partial cross-sectional view of the pad shown in FIG. 3 including the spring connection thereto and a protective bottom layer for the resistive heating element thereof.

The pad 36 is formed from a ceramic chip or like material that will be able to withstand the abrasion and heating encountered in its duty cycle. It includes a resistive heating element 50 that would typically be deposited or formed therein and a protective layer 52 to shield the resistive element and thereby prolong its operating life. The pad 36 is coupled, in this instance both electrically and mechanically, to the arm 40 by means of spring 38 which is selected to have a predetermined spring constant. Electrical connection to the pad 36, via the spring 38, is completed by the lead 48 which runs through the arm 40 as is shown in FIG. 2. The lead 48 can be connected either directly to the voltage source 24 or through or adjacent the write electrode 18 to the control circuit means 26. Pad 36 is made approximately as wide as the write electrode 18 in this embodiment or as wide as a write head assembly in a full scale printer, wide enough in either case to cover the width of recording medium 10 which is to be printed upon. The pad 36 includes, as previously noted, the patterned resistance heating element 50, shown in FIG. 3, which heats the pad 36 when current is passed therethrough and the thin protective covering layer 52, see FIG. 4, for shielding the resistive element 50 from abrasive wear. Layer 52 is not shown in FIG. 3 for the sake of clarity. It is made thick enough to protect the resistive element 50, but not so thick as to inhibit heat transfer to the bottom and contact surface of pad 36. Typically, the protective layer 52 will be about 100 microns thick.

In operation, the applicator 30 spreads liquid atop the surface layer 12 prior to the recording medium 10 reaching the pad 36. The pad has been warmed and remains so by passing current through its resistance element. The pad 36 rides up and onto the water forcing it down into the surface layer 12. The pressure applied by the pad 36 accounts for a liquid penetration increase of three to four times that achieved without the pad. The heat from the pad 36 warms the surface layer 12 materials and the liquid as well, which accelerates penetration of the liquid into the surface layer 12 and also speeds up the rates of chemical and electrolytic reaction. The benefits of the preheating pressure pad 36 are both significant and immediate.

The acceleration in penetration and reaction rates allows the use of reduced write electrode voltages. This reduction has approached and sometimes exceeded a factor of two, meaning that in most cases successful low energy input printing can be accomplished with write electrode voltages in the range of 10 to 18 volts as opposed to the prior, non-pad arrangement of 15 to 25 volts. In addition, the use of the pad 36 leaves little or no liquid on the surface layer 12 which prevents puckering and enhances drying rates. It also eliminated the need to "double-wet" a recording medium to insure that it was not excessively dry internally.

While the present invention has been described in the context of a preferred embodiment thereof, it will be readily apparent to those skilled in the appertaining art, that modifications and variations can be made therein without departing from the spirit and scope of the present invention. Accordingly, it is not intended that the present invention be limited to the specifics of the foregoing description of the preferred embodiment. Instead, the present invention should be considered as being limited solely by the appended claims which alone are intended to define its scope.

Having thus described my invention, what I claim as new, and desire to secure by Letters Patent is:

1. Preheating appratus for an electrolytic based printer having at least one write electrode for applying electrical pulses in a print zone to a recording medium used therein, transport means for moving the recording medium to and beneath the write electrode in the print zone, applicator means positioned to meter a liquid onto the surface of the according medium before it reaches the print zone and the write electrode, a source of electrical energy and control circuit means connected between the source and the write electrode for generating and forwarding pulses of appropriate amplitude and duration to the write electrode, said apparatus comprising;

(a) support arm means coupled to the write electrode for movement therewith;

(b) a pad having heating means incorporated therein for heating the bottom of said pad and the area of the recording medium it contacts prior to passage of the contacted area into the print zone; and (c) biasing means connected to and between said support arm means and said pad for normally urging the bottom of said pad into contact with the recording medium and for forcing liquid deposited by the applicator on the surface thereof down into the recording medium as it passes beneath said pad.

2. The apparatus according to claim 1 wherein said biasing means is fabricated from electrically conductive material and said support arm means includes a conductor for making electrical connection between the source of electrical energy and said conductive biasing means whereby said heating means of said pad will be energized when current flows in said conductor.

3. The apparatus according to claim 1 which additionally comprises movable coupling means for joining said support arm means to the write electrode so that said arm is movable at least with respect to the write electrode normal to the plane of the recording medium.

4. The apparatus according to claim 1 wherein said pad additionally comprises a protective layer formed across the bottom contact surface thereof to shield said heating means from abrasive wear.

5. The apparatus according to claim 2 which additionally comprises movable coupling means for joining said support arm means to the write electrode so that said arm is movable at least with respect to the write electrode normal to the plane of the recording medium.

6. The apparatus according to claim 5 wherein said pad additionally comprises a protective layer formed across the bottom contact surface thereof to shield said heating means from abrasive wear.

7. The apparatus according to claim 2 wherein said pad additionally comprises a protective layer formed across the bottom contact surface thereof to shield said heating means from abrasive wear.

8. The apparatus according to claim 3 wherein said pad additionally comprises a protective layer formed across the bottom contact surface thereof to shield said heating means from abrasive wear.

* * * * *